US007529343B2

(12) United States Patent
Safai et al.

(10) Patent No.: US 7,529,343 B2
(45) Date of Patent: May 5, 2009

(54) SYSTEM AND METHOD FOR IMPROVED FIELD OF VIEW X-RAY IMAGING USING A NON-STATIONARY ANODE

(75) Inventors: Morteza Safai, Seattle, WA (US); Gary E. Georgeson, Federal Way, WA (US); William T. Edwards, Foristell, MO (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 11/744,115

(22) Filed: May 3, 2007

(65) Prior Publication Data

US 2007/0269014 A1 Nov. 22, 2007

Related U.S. Application Data

(60) Provisional application No. 60/746,481, filed on May 4, 2006.

(51) Int. Cl.
*H01J 35/18* (2006.01)

(52) U.S. Cl. ..... 378/125; 378/144; 378/86

(58) Field of Classification Search ..... 378/125, 378/57, 4, 144, 86–87
See application file for complete search history.

(56) References Cited

U.S. PATENT DOCUMENTS

| | | | | |
|---|---|---|---|---|
| 4,107,563 | A | | 8/1978 | Oddell |
| 4,577,337 | A | | 3/1986 | Light |
| 5,181,234 | A | | 1/1993 | Smith |
| 5,243,665 | A | | 9/1993 | Maney et al. |
| 5,260,982 | A | | 11/1993 | Fujii et al. |
| 5,438,605 | A | * | 8/1995 | Burke et al. ..... 378/135 |
| 5,729,620 | A | | 3/1998 | Wang |
| 5,763,886 | A | | 6/1998 | Schulte |
| 5,923,573 | A | | 7/1999 | Hatanaka |
| 6,094,472 | A | | 7/2000 | Smith |
| 6,282,260 | B1 | | 8/2001 | Grodzins |
| 6,292,533 | B1 | | 9/2001 | Swift et al. |
| 6,370,222 | B1 | | 4/2002 | Cornick, Jr. |

(Continued)

FOREIGN PATENT DOCUMENTS

| | | |
|---|---|---|
| DE | 3142349 | 5/1983 |
| EP | 1227316 | 7/2002 |
| JP | 04309187 A | 10/1992 |
| JP | 2006040053 A | 2/2006 |
| WO | WO 00/33059 | 6/2000 |
| WO | WO 2007/129249 | 11/2007 |

OTHER PUBLICATIONS

International Search Report on corresponding PCT application (PCT/US2007/010843) from International Searching Authority (EPO) dated Dec. 12, 2007.

(Continued)

*Primary Examiner*—Hoon Song
(74) *Attorney, Agent, or Firm*—Klein, O'Neill & Singh, LLP

(57) ABSTRACT

An X-ray imaging system is provided which includes an X-ray tube including, a cathode for emitting electrons; and a dynamic anode. The dynamic anode receives the electrons from the cathode and generates an X-ray beam that is non-stationary. The dynamic anode rotates between a first position where the X-ray beam is directed at a first location on an object and a second position where the X-ray beam is directed at a second location on the object to generate the non-stationary beam.

13 Claims, 9 Drawing Sheets

U.S. PATENT DOCUMENTS

| | | | | |
|---|---|---|---|---|
| 6,424,695 | B1 | 7/2002 | Grodzins et al. | |
| 6,501,822 | B2 | 12/2002 | Roder | |
| 6,546,072 | B1 | 4/2003 | Chalmers | |
| 6,560,315 | B1 * | 5/2003 | Price et al. | 378/144 |
| 6,618,465 | B2 * | 9/2003 | Mohr et al. | 378/58 |
| 6,637,266 | B1 | 10/2003 | Froom | |
| 6,735,279 | B1 | 5/2004 | Jacobs et al. | |
| 6,757,353 | B2 | 6/2004 | Furze | |
| 6,888,640 | B2 | 5/2005 | Spina et al. | |
| 6,950,495 | B2 | 9/2005 | Nelson et al. | |
| 6,950,719 | B2 | 9/2005 | Landers et al. | |
| 7,024,272 | B2 | 4/2006 | Thomas et al. | |
| 7,069,192 | B1 | 6/2006 | Freitag | |
| 7,086,028 | B1 | 8/2006 | Davis et al. | |
| 7,099,434 | B2 | 8/2006 | Adams et al. | |
| 7,103,434 | B2 | 9/2006 | Chernyak et al. | |
| 7,203,276 | B2 | 4/2007 | Arsenault et al. | |
| 7,218,704 | B1 | 5/2007 | Adams et al. | |
| 7,224,772 | B2 | 5/2007 | Jacobs et al. | |
| 7,280,990 | B2 | 10/2007 | Turner et al. | |
| 7,305,063 | B2 * | 12/2007 | Heuscher | 378/12 |
| 2001/0016803 | A1 | 8/2001 | Sartiono et al. | |
| 2002/0123812 | A1 | 9/2002 | Jayaram et al. | |
| 2003/0043964 | A1 | 3/2003 | Sorenson | |
| 2004/0264626 | A1 * | 12/2004 | Besson | 378/4 |
| 2007/0189454 | A1 | 8/2007 | Georgeson et al. | |

OTHER PUBLICATIONS

Written Opinion on corresponding PCT application (PCT/ US2007/010843) from International Searching Aurthority (EPO) dated Dec. 12, 2007.

Lockwood et al, "Field Tests of X-ray Backscatter Mine Detection", Detection of Abandoned Land Mines, 1998. Second International Conference on the (Conf. Publ. No. 458) Edinburgh, UK Oct. 12-14, 1998, London, UK, IEE, UK, Oct. 12, 1998, pp. 160-163, XP006505028, ISBN: 0-85296-711-X.

Poranski et al, "X-ray Backscatter Tomography for Nondestructive evaluation at the Naval Research Lab", Proc. SPIE Int Soc Opt Eng; Proceedings of SPIE—The International Society for Optical Engineering 1995 Society of Photo-Optical Instrumentation Engineers, Bellingham, WA, USA, vol. 2459, 1995, pp. 70-78, XP002462304.

International Search Report on related PCT application (PCT/ US2007/010758) from International Searching Authority (EPO) dated Jan. 10, 2008.

Written Opinion on related PCT application (PCT/ US2007/010758) from International Searching Authority (EPO) dated Jan. 10, 2008.

Basak et al.; "A Feature Based Parametric Design Program and Expert System for Design"; 2004; Association for Scientific Research: Mathematical and Computational Applications; vol. 9, No. 3, pp. 359-370.

Haifen et al.; "Feature-based Collaborative Design", 2003; Elsevier; Journal of Materials Processing Technology; vol. 139; pp. 613-618.

Sanami et al.; "A Proposal of Assembly Model Framework Specialized for Unified Parametrics"; 10th International Conference on Precision Engineering; Yokohama, Japan; Jul. 18-20, 2001; Tokyo University of Agriculture and Technology; Kitajima Laboratory; pp. 962-966.

Wang et al.; Geometry-based Semantic ID for Persistent and Interoperable Reference in Feature-based Parametric Modeling; 2005; Elsevier; Computer-Aided Design; vol. 37; pp. 1081-1093.

Yancey; "CT-Assisted Reverse Engineering for Aging Aircraft Resupply"; Mar. 1998; XP002441957.

Zhu et al.; "X-ray Compton backscattering techniques for process tomography: imaging and characterization of materials"; Measurement Science and Technology; Mar. 1, 1996; vol. 7, No. 3, pp. 281-286; XP020063979; Insititue of Physics Publishing; Bristol; UK.

Non-Final Office Action dated Jul. 13, 2006 on related US application (U.S. Appl. No. 11/352,118).

Final Office Action dated Dec. 28, 2006 on related US application (U.S. Appl. No. 11/352,118).

Non-Final Office Action dated Jun. 14, 2007 on related US application (U.S. Appl. No. 11/352,118).

Final Office Action dated Nov. 14, 2007 on related US application (U.S. Appl. No. 11/352,118).

International Search Report and the Written Opinion of the International searching Authority (EPO) dated Jul. 30, 2007 on the related PCT application (PCT/US2007/003466).

Alan R. Crews et al., X-Ray Computed Tomography for Geometry Acquisition, Mar. 1993, Materials Directorate, Wright Laboratory, Air Force Materiel Command, Wright-Patterson Air Force Base; National Technical Information Service; Published in: US.

Z Backscatter; http://www.as-e.com/products_solutions/z_backscatter.asp; American Science and Engineering, Inc. (Image obtained from Internet Archive [http://www.archive.org/index.php] and represents webpage as it appeared on Apr. 4, 2005).

Shedlock et al, "Optimization of an RSD x-ray backscatter system for detecting defects in the space shuttle external tank thermal foam insulation", Penetrating Radiation Systems and Applications VII. Edited by Doty, F. Patrick; Barber, H. Bradford; Roehrig; Roehrig, Hans. Proceedings of the SPIE, vol. 5923, pp. 205-216 (2005).

Non-Final Office Action on co-pending U.S. Appl. No. 11/739,835 dated Sep. 5, 2008.

Non-Final Office Action on co-pending U.S. Appl. No. 11/352,118 dated Oct. 16, 2008.

Notice of Allowance on co-pending U.S. Appl. No. 11/739,835 dated Nov. 24, 2008.

* cited by examiner

SYSTEM AND METHOD FOR IMPROVED FIELD OF VIEW X-RAY IMAGING USING A NON-STATIONARY ANODE

CROSS-REFERENCE TO RELATED APPLICATIONS

This application claims the benefit and priority to provisional patent application Ser. No. 60/746,481, filed on May 4, 2006, and to application, Ser. No. 11/352,118, filed on Feb. 10, 2006, the entire contents of which are hereby incorporated by reference.

FIELD OF THE DISCLOSURE

The present invention relates to X-ray imaging, and more particularly, an X-ray imaging system having a non-stationary anode for improved field of view imaging.

BACKGROUND

Vacuum tubes including rotating anodes bombarded by energetic electrons are well developed and extensively used, particularly as X-ray tubes where the anode includes a rotating X-ray emitting track bombarded by electrons from a cathode. The anode is rotated so at any instant only a small portion thereof is bombarded by the electrons. Thus, since the energetic electrons are distributed over a relatively large surface area.

However, heretofore using a rotating anode was done merely to keep the anode from becoming too hot. In addition, in the conventional X-ray system, where the X-ray tube may be powered on for long periods of time, the anode may also need to be cooled using a running liquid that removes heat from the anode.

In any event, the rotating anode of a typical X-ray system provides merely a stationary beam; that is to say the X-ray beam is always pointed at one particular location on the target. The use of a rotating anode within the X-ray tube has not, heretofore, been used to expand the imaging field of view, while maintaining low power requirements.

What is needed is an X-ray imaging system that has an expanded imaging field of view, while simultaneously requiring less power.

SUMMARY

An improved system and associated method are provided for increasing the field of view of an X-ray imaging system, while maintaining low power requirements. The disclosure provides for increasing the field of view in an X-ray imaging system by using an X-ray tube having a dynamic anode, which provides a non-stationary X-ray beam. The dynamic anodes of the present disclosure, which provides a non-stationary X-ray beam, allows for a more uniform and wider inspection area or field of view (compared to systems using anodes, which provide stationary X-ray beams).

In one aspect, an X-ray imaging system is provided. The system includes an X-ray tube including, a cathode for emitting electrons; and a dynamic anode. The dynamic anode receives the electrons from the cathode and generates an X-ray beam that is non-stationary. The dynamic anode rotates between a first position where the X-ray beam is directed at a first location on an object and a second position where the X-ray beam is directed at a second location on the object to generate the non-stationary beam.

In another aspect, a method is provided for imaging. The method includes providing an X-ray tube having a moveable anode; and moving the moveable anode between a first position where the moveable anode directs an X-ray beam at a first location on an object to a second position where the moveable anode directs an X-ray beam at a second location on the object.

Advantageously, electron bombardment and X-ray generation distributed using dynamic anodes creates less heat, which in turn requires less cooling than a typical X-ray imaging system. By requiring less cooling and a smaller cooling system, the size of the X-ray tube may be reduced allowing for a smaller, portable X-ray imaging system. Furthermore, dynamic anodes may operate at approximately 1/10 the wattage of a conventional X-ray imaging system; this also improves the life of the dynamic anode.

Furthermore, using a dynamic anode may reduce the size of the X-ray tube which may result in a less hazardous X-ray tube that is more environmentally friendly as less radiation is emitted and less of the X-ray beam is lost when compared to a typical X-ray tube with a stationary anode. Smaller X-ray tubes require less shielding so that the resulting X-ray imaging system may be lighter, smaller and more portable. The use of a smaller X-ray tube to radiate objects limits the focus of the emissions, thus less power is lost in the form of heat and X-rays not being used to create an image.

Another advantage of using dynamic anodes is it allows for a larger, more parallel X-ray fan without loss in X-ray photon density or an increase in geometric unsharpness. Geometric unsharpness occurs when an X-ray fan emanating from an anode is too wide. This also results in a reduction of contrast at the edge of the fan. The present disclosure provides for the use of a small focal spot size, which equates to a sharper image and higher resolution.

In certain embodiments the system is compact and lightweight so that it can be easily transported and used within confined spaces or in environments where weight is a consideration, such as inside or underneath aircraft. Because systems and structures in aircraft environments have various orientations and limitations to access, the system is portable and adaptable.

This brief summary has been provided so that the nature of the disclosure may be understood quickly. A more complete understanding of the disclosure can be obtained by reference to the following detailed description of the embodiments thereof in connection with the attached drawings.

BRIEF DESCRIPTION OF THE DRAWINGS

The foregoing features and other features of the disclosure will now be described with reference to the drawings of various objects of the disclosure. The illustrated embodiment is intended to illustrate, but not to limit the disclosure. The drawings include the following.

DETAILED DESCRIPTION

The present system is described herein with reference to two example embodiments. Those of ordinary skill in the art will appreciate, however, that these embodiments are merely examples. Alternative configurations from those shown in the attached figures may also embody the advantageous characteristics described above. These alternative configurations are within the scope of the present system.

Figure 1:
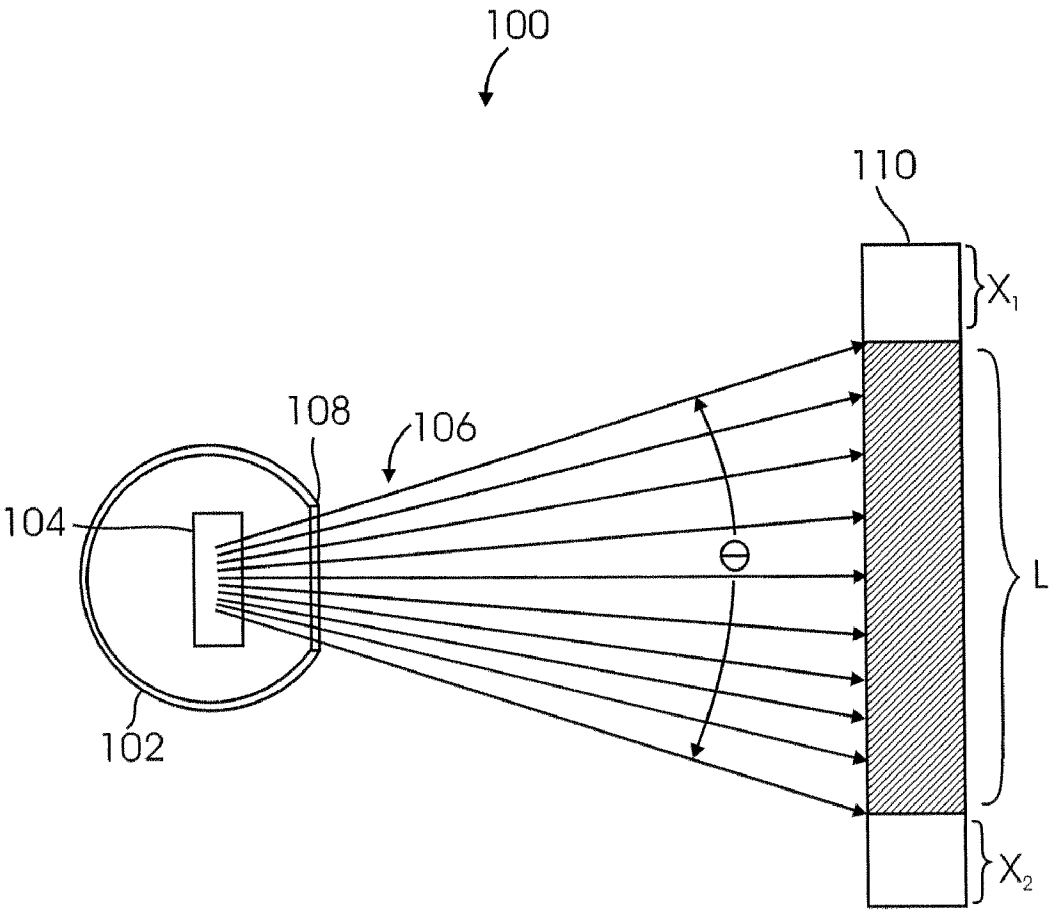
FIG. 1 (Prior Art)
FIG. 1 is a simplified schematic top view of a typical X-ray tube having an anode which delivers a stationary X-ray beam.

FIG. 1 is a simplified top view of a typical X-ray imaging system 100, including an X-ray tube 102 and an anode 104, which provides only a stationary X-ray beam (hereinafter "stationary anode 104"). Generally, X-ray tube 102 is a vacuum tube and includes a cathode 302 (FIG. 3) which emits electrons into the vacuum. Stationary anode 104 collects the electrons, establishing a flow of electrical current through X-ray tube 102. To generate the X-ray beam, electrons are boiled off the cathode by means of thermo-ionic-emission, and are collided with the anode under a high energy electric field. X-rays are produced when the electrons are suddenly decelerated upon collision with the anode. If the bombarding electrons have sufficient energy, they can knock an electron out of an inner shell of the target metal atoms. Then, electrons from higher states drop down to fill the vacancy, emitting X-ray photons with precise energies determined by the electron energy levels and generating an X-ray fan with the maximum flux of the beam at the center of the cone. The beam is radially symmetric within a circular fan or cone of X-rays.

Stationary anode 104 generates the X-ray beam 106, which is emitted out from X-ray tube 102 through window 108. In this example, X-ray beam 106 provides instantaneous coverage 'L' to the extent of cone angle θ. The volume of electron bombardment and X-ray generation required to provide full coverage L of object 110 requires a large amount of power and creates large amounts of heat, which in turn requires a large cooling system. By requiring large amounts of power and a large cooling system, the size of X-ray tube 102 must also be large.

Referring again to FIG. 1, top and bottom portions $X_1$ and $X_2$ of object 110 lie outside cone angle θ and are therefore not subject to examination by X-ray beam 106. As a result, a detector (not shown) would not receive data related to portions $X_1$ and $X_2$ and these portions are therefore not included in any X-ray images generated of object 110.

Figure 2A:
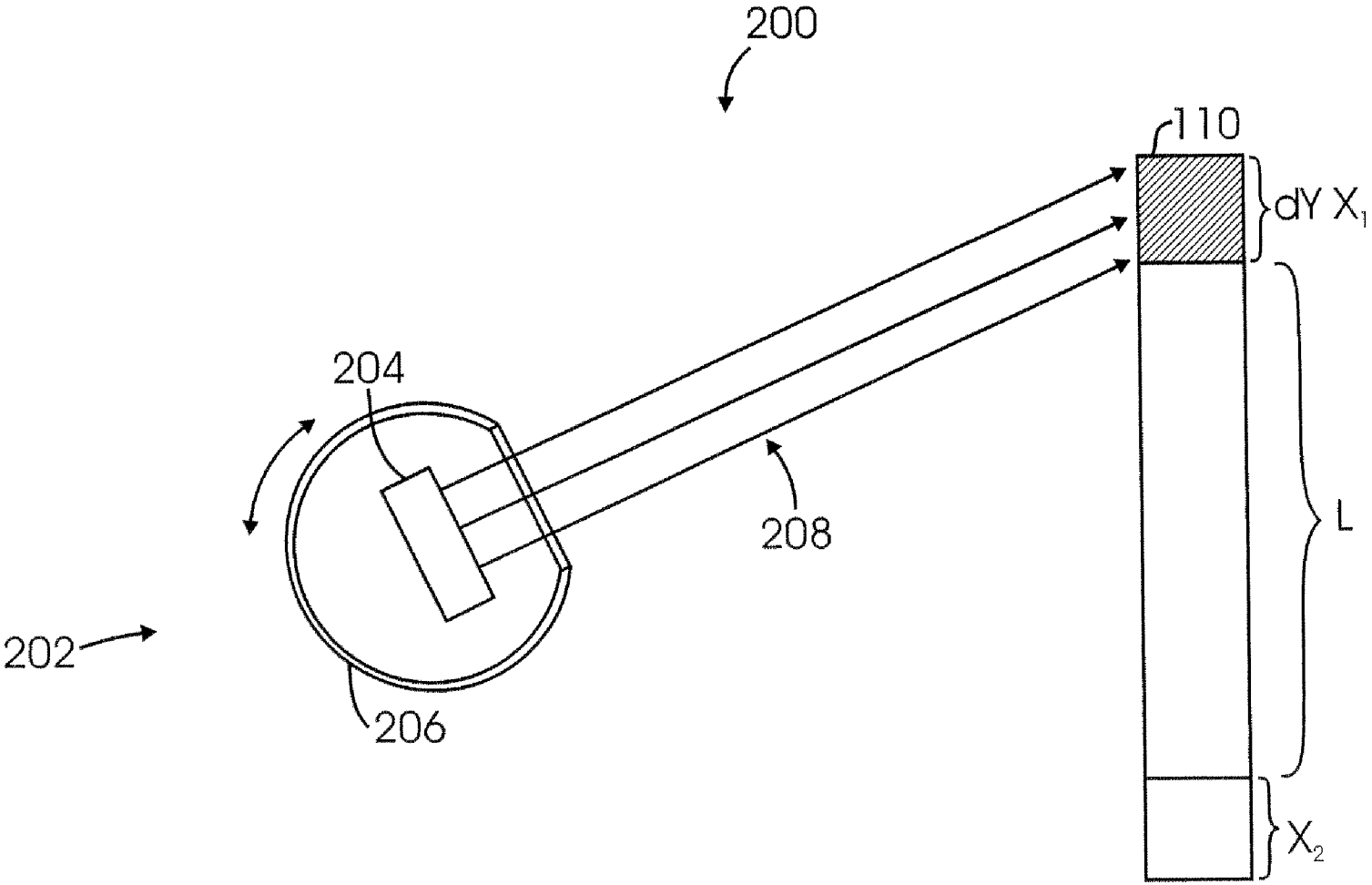
FIGS. 2A, 2B and 2C are simplified schematic top views of an X-ray tube having an anode which delivers a non-stationary X-ray beam, according to one embodiment of the disclosure.
Figure 2B:
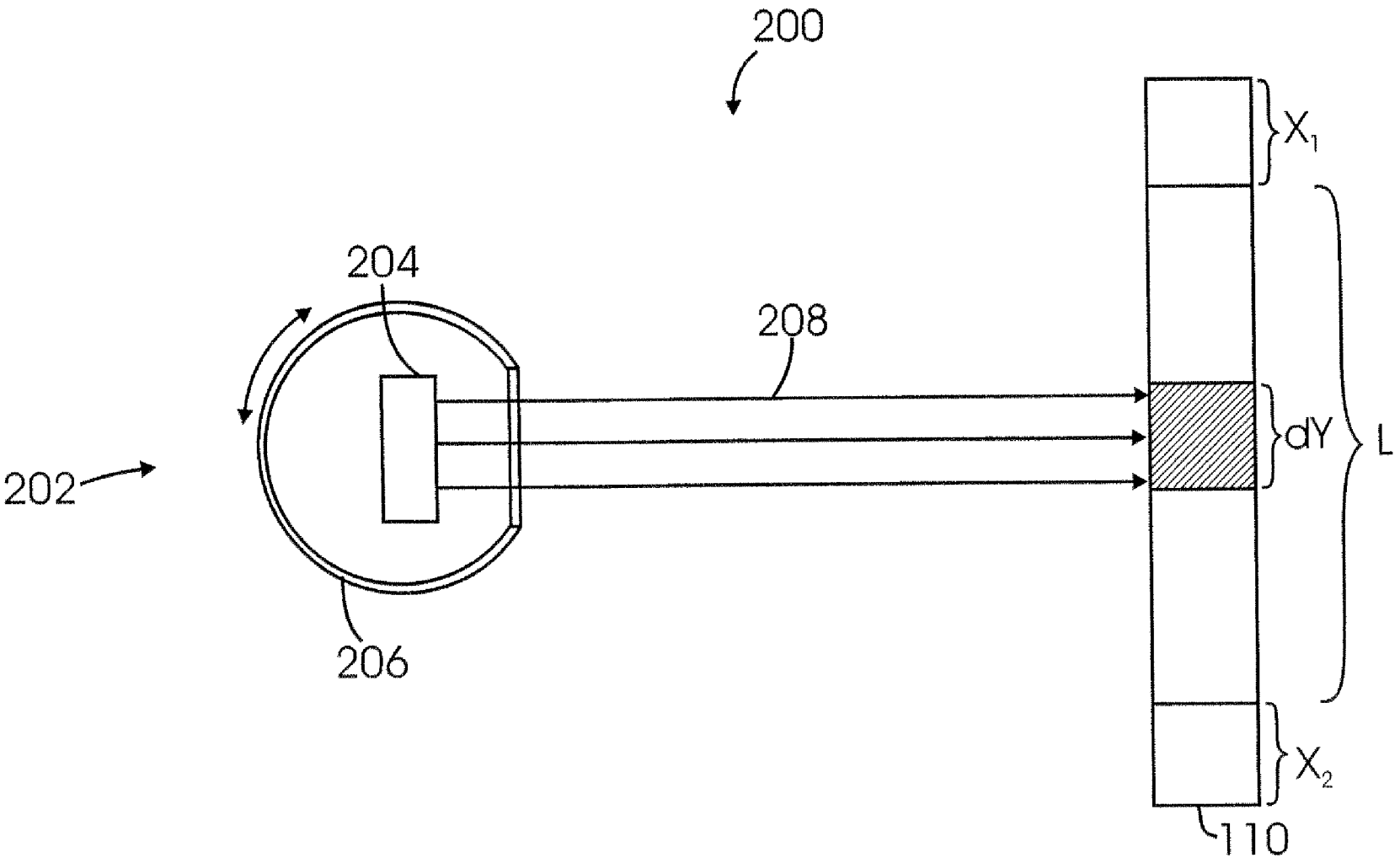
Figure 2C:
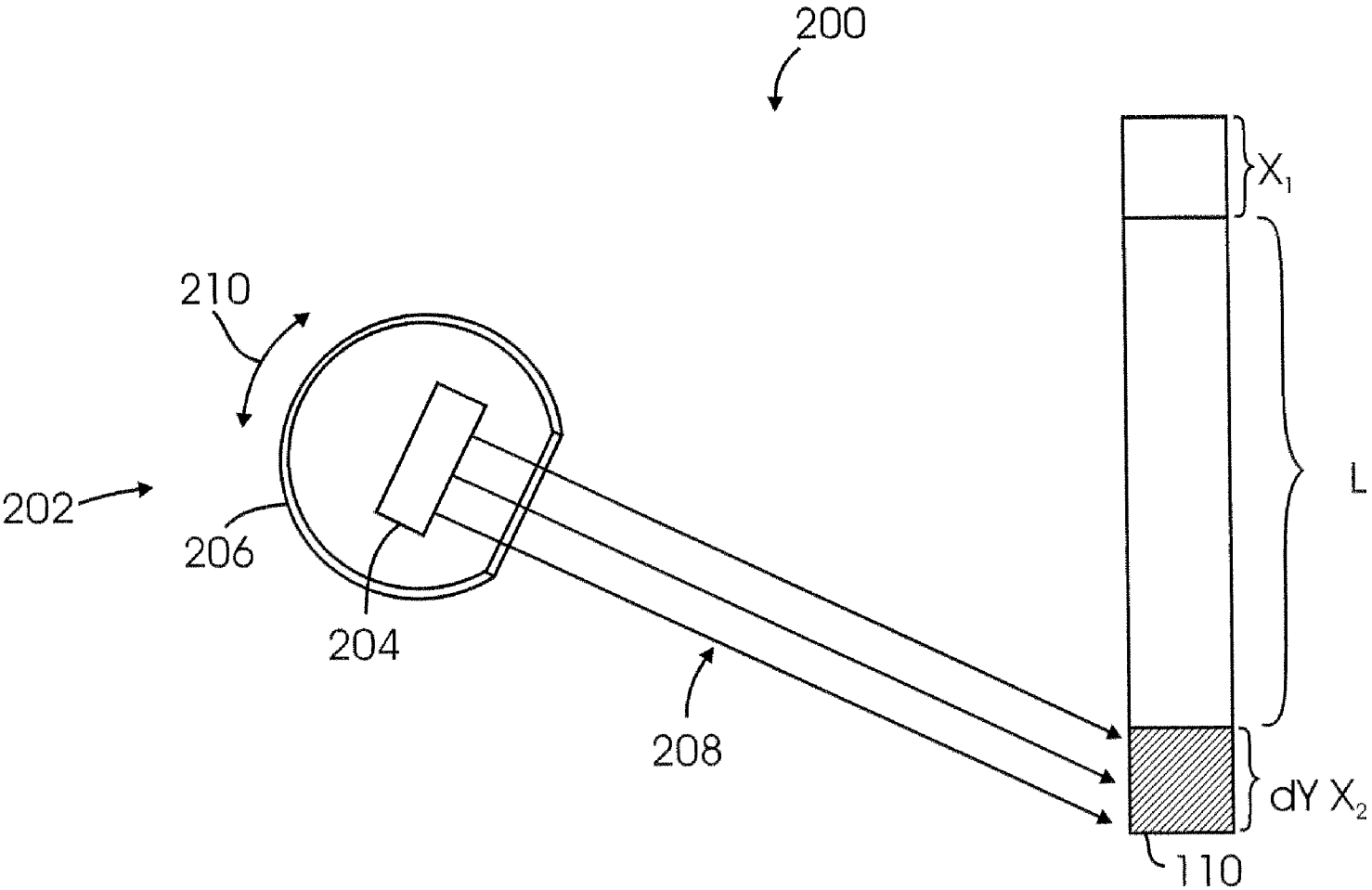
Figure 3:
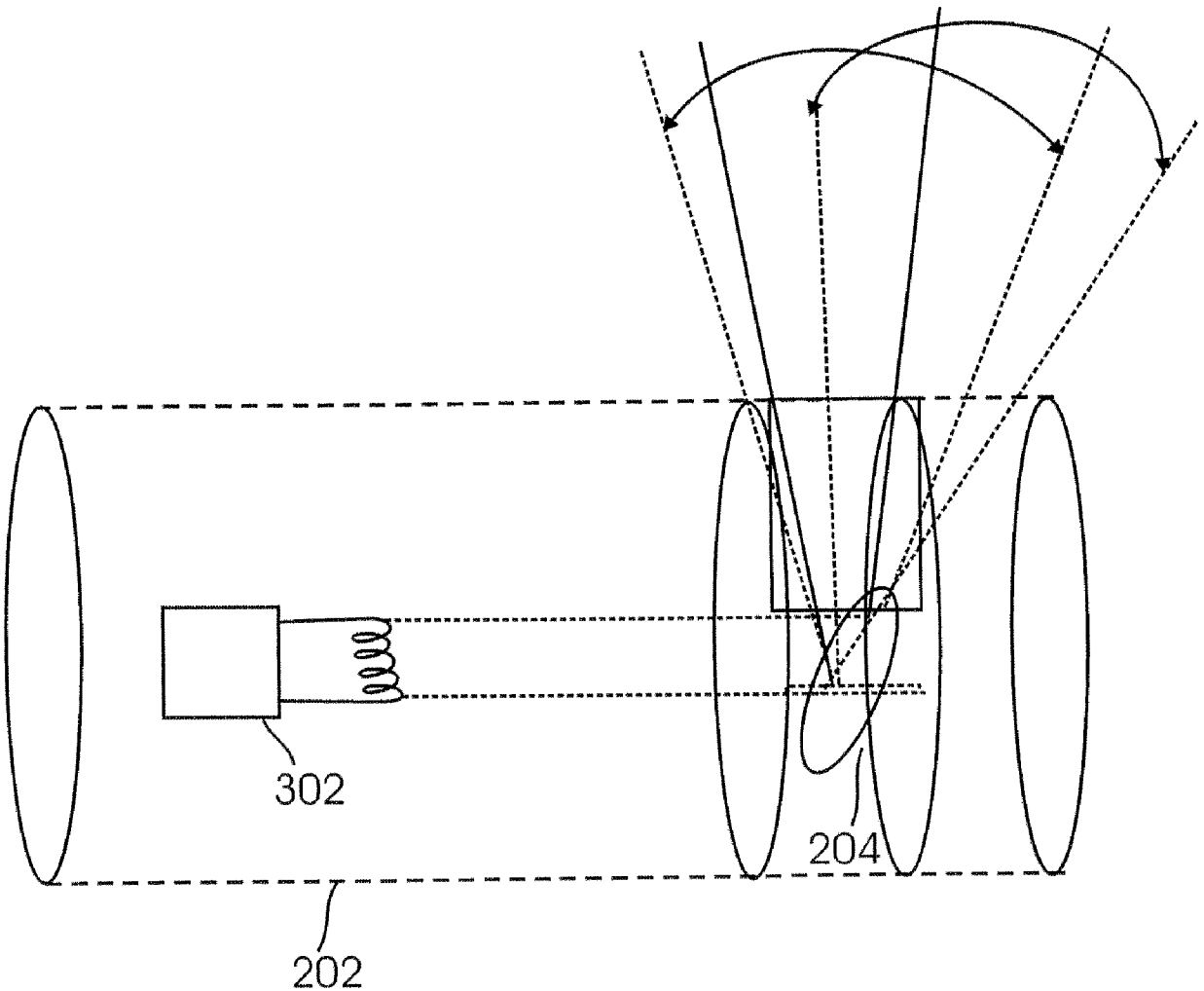
FIG. 3 is a simplified schematic side view of the X-ray tube of FIG. 2A.

FIGS. 2A, 2B, 2C are simplified schematic top views and FIG. 3 is a simplified side view, of an X-ray imaging system 200 in accordance with an embodiment of the disclosure. X-ray imaging system 200 includes X-ray tube 202 having dynamic anode 204, a cathode 302, and a continuous window 206, which allows for up to a 360° emission of X-ray beam 208 for a wider area of imaging.

In operation, cathode 302 emits electrons into the vacuum of X-ray tube 202. Dynamic anode 204 collects the electrons to establish a flow of electrical current through X-ray tube 202. Dynamic anode 204 generates an X-ray beam 208 that emits through window 206 in X-ray tube 202 to create an image of object 110 under examination.

In this embodiment, dynamic anode 204, is an anode that is made to move within X-ray tube 202, such that X-ray beam 208 is made to scan across object 110.

For example, referring to FIG. 2A, in operation, dynamic anode 204 may be pointed in a first direction, such as toward top portion $X_1$. While pointed at position $X_1$, beam 208 covers a portion $dY_1$ of object 110, which is proportional to the width of beam 208.

As shown in FIG. 2B, dynamic anode 204 may then be rotated as indicated by arrow 210 causing beam 208 to continuously move across an incremental portion dY across the length of the entire object 110.

As shown in FIG. 2C, dynamic anode 204 may continue to rotate until beam 208 is pointed in a second direction, such as toward bottom portion $X_2$ of object 110, covering the incremental portion dY. In this manner, beam 208 is made to image the entire length ($X_1$+$X_2$+L) at increments dY. The rate of rotation of dynamic anode 204 may be set to any desired rate which provides adequate imaging for an intended purpose. In one embodiment, the rate of rotation of dynamic anode 204 may range from about 5 revs/sec to about 25 revs/sec. Dynamic anode 204 may be made to rotate or otherwise move to provide a non-stationary beam using any conventional means, such as a motor and gear arrangement and the like inside of the X-ray tube.

In another embodiment, an X-ray backscatter system is provided which includes an X-ray tube (vacuum tube) that generates photons, and at least one silicon-based detector or photo-multiplier tube. Generally, photons emerge from the source or anode in a collimated "flying spot" beam that scans vertically. Backscattered photons are collected in the detector(s) and used to generate two-dimensional or three-dimensional images of objects. The angle over which the spot travels is limited by the X-ray fan angle coming off the anode.

An X-ray backscatter Non-Line-of-Sight Reverse Engineering application is the subject of U.S. patent application Ser. No. 11/352,118, entitled Non-Line Of Sight Reverse Engineering For Modifications Of Structures And Systems, filed on Feb. 10, 2006, the disclosure of which is assigned to the assignee of the present application, and the disclosure of which is incorporated herein by reference in its entirety.

Figure 4:
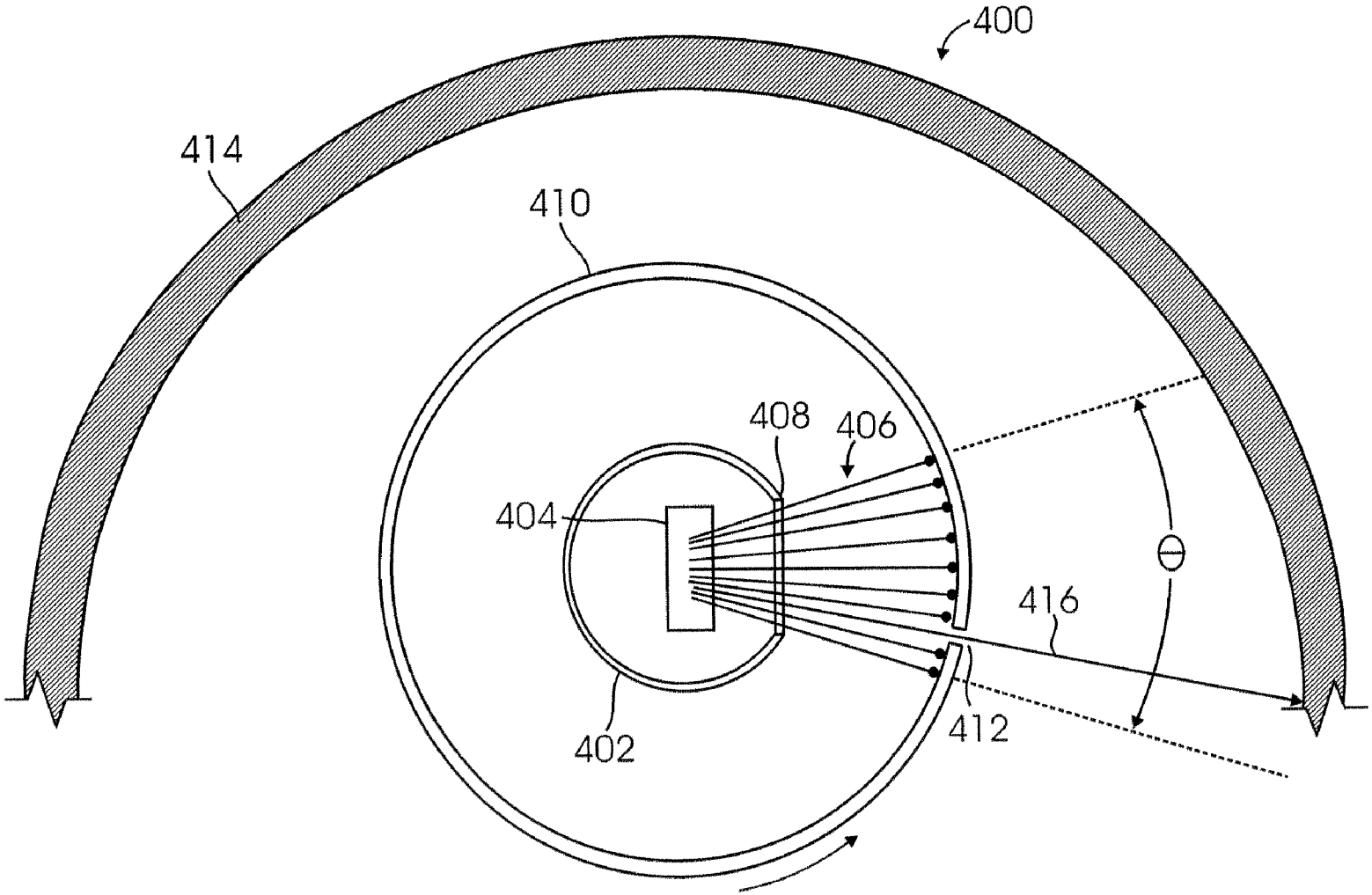
FIG. 4 is a simplified schematic top view of a typical X-ray backscatter system having an anode which delivers a stationary X-ray beam.

FIG. 4 is a simplified top view of a typical X-ray backscatter system 400, including an X-ray tube 402 and an anode 404, which provides only a stationary X-ray beam (hereinafter "stationary anode 404"). Stationary anode 404 generates the X-ray beam 406, which is emitted from X-ray tube 402 through window 408.

In one embodiment, a rotating collimator 410, having an aperture 412, encircles X-ray tube 402 and rotates around stationary anode 404 such that aperture 412 rotates across the length of window 408. A portion of X-ray beam 406 passes through aperture 412 as aperture 412 rotates across window 408.

In this example, stationary anode 404 X-ray directs beam 406 to the internal side of collimator 410. Beam 406 impinges on collimator 410 to the extent of cone angle θ. As aperture 412 of collimator 410 passes through beam 406 a small portion 416 of beam 406 passes through to provide coverage on object 414. Since most of beam 406 is not used to impinge on to object 414, the power used to generate beam 406 is wasted.

Figure 5:
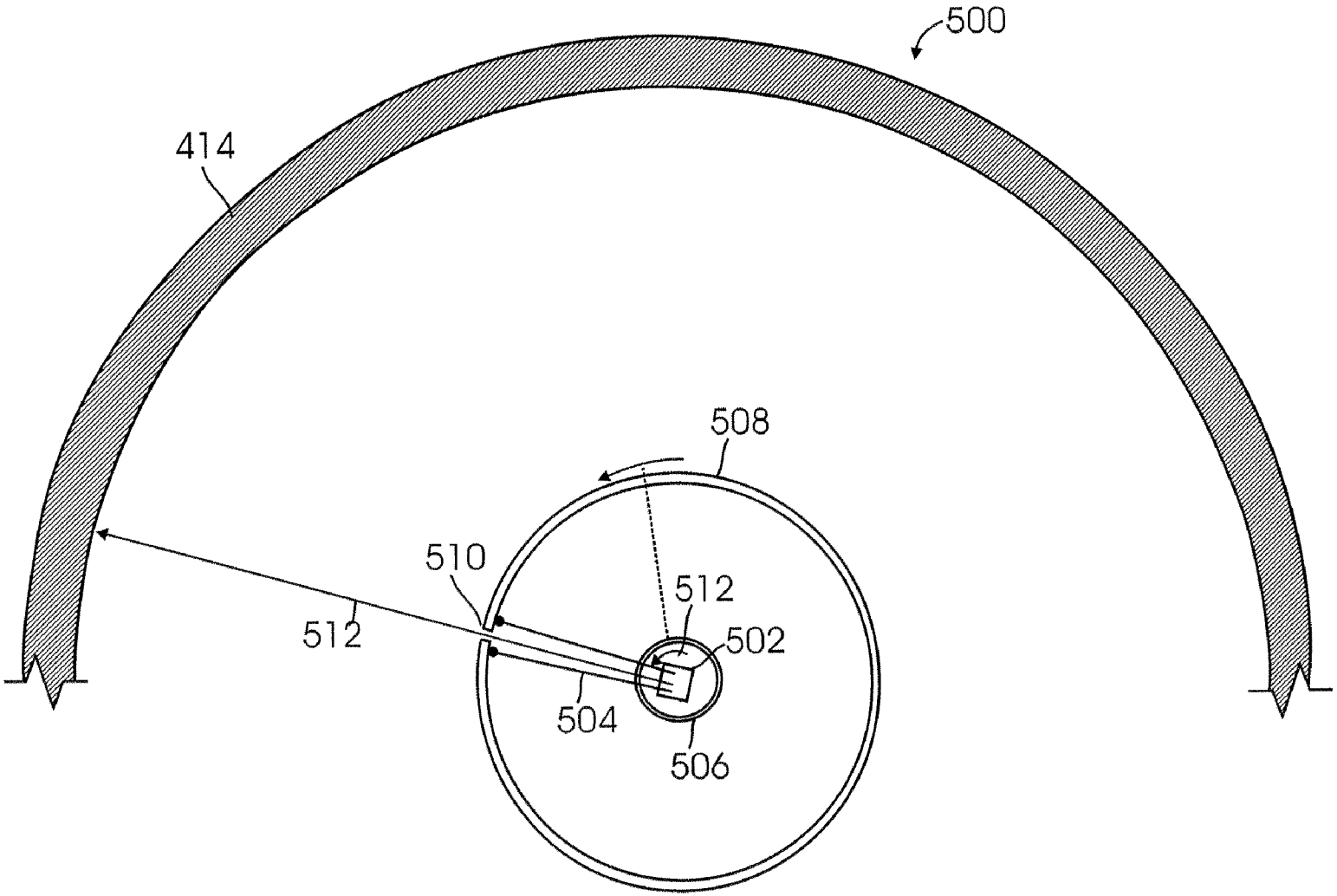
FIG. 5 is a simplified schematic top view of an X-ray backscatter system having an anode which delivers a non-stationary X-ray beam, according to one embodiment of the disclosure.

FIG. 5 is a simplified illustration of an operational embodiment of an X-ray system 500, including dynamic anode 502, which can be made to rotate within the X-ray tube, for example, in the direction of arrow 512. X-ray system 500 also includes continuous window 506, and a rotating collimator 508 having aperture 510, which surrounds dynamic anode 502. Generally, beam 504 is directed through aperture 510 to impinge on object 414 as rotating collimator 508 rotates about anode 502. The X-rays back-scattered from the object are picked up by a photo multiplier tube or solid state detector (not shown), which generates electric signals that can be used to produce an image.

In one operational embodiment, the relative rotation of dynamic anode 502 and of rotating collimator 508 is linked. Accordingly, in this embodiment, aperture 510 can be made to rotate in constant alignment with dynamic anode 502. By linking the relative rotation of anode 502 and collimator 508, X-ray beam 504 may be directed specifically at aperture 510 during the entire imaging operation. Because beam 504 is concentrated directly in the vicinity of aperture 510 during the entire imaging operation, the concentration 512 of beam 504 which actually passes through aperture 510 represents a large percentage of the actual beam 504.

Thus, the efficiency associated with using a more concentrated beam 504 continuously directed at aperture 510 as collimator 508 and anode 502 rotate, allows for using a smaller anode with a less powerful beam. In turn, the smaller anode allows the dimensions of the X-ray tube to also be reduced, because of the lower size and power requirements.

By directing beam 504 continuously at aperture 510 during an imaging operation also allows for complete circumferential beam coverage to cover a larger area of inspection with a larger field of view. Alternatively, X-ray beam 504 may be made to obtain a more concentrated X-ray at a particular location.

Although the system and method of the present disclosure are described with reference to a flying spot X-ray system (backscatter and transmission), those skilled in the art will recognize that the principles and teachings described herein may also be applied to conventional transmission X-ray systems and X-ray tomography systems.

Figure 6:
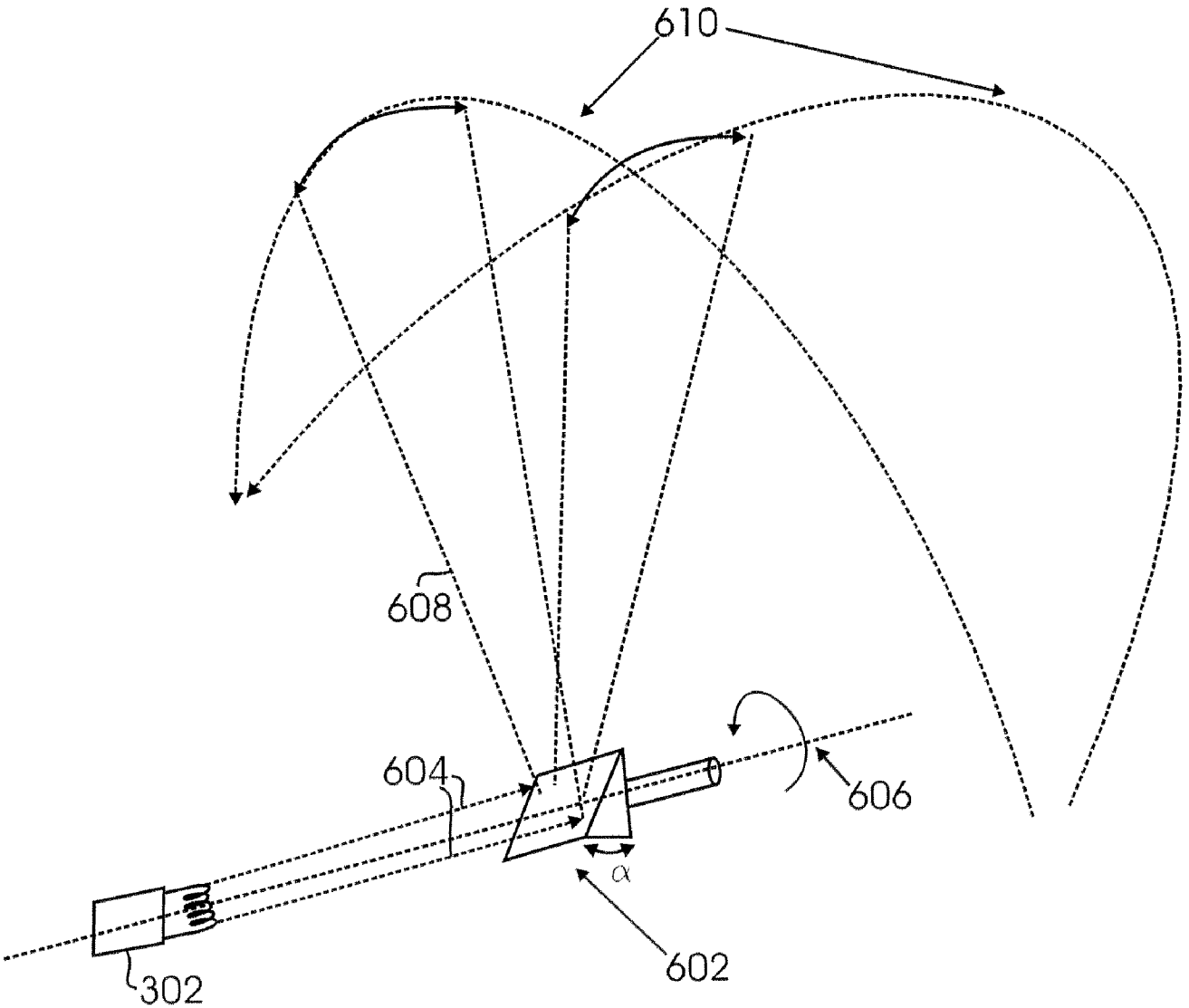
FIG. 6 is a simplified schematic view of the internal structure of an X-ray tube having an oscillating anode, according to one embodiment of the disclosure.

FIG. 6 is a simplified schematic view of the internal structure of an X-ray system including an X-ray tube having an oscillating anode, according to one embodiment of the disclosure. In this embodiment, anode 602 may be made to oscillate, for example, as opposed to rotate. Oscillating anode 602 collects electrons represented by arrows 604 while oscillating back and forth about a central axis 606 of the X-ray tube.

In this embodiment, oscillating anode 602 increases the X-ray photon lobe angle without reducing the total number of photons per square centimeter. X-ray beam 608 is then emitted from oscillating anode 602 generating an X-ray fan area 610, such that X-ray beam 608 is made to sweep across an object continuously to the endpoints of the oscillation.

Beneficially, oscillating anode 602 allows for an instantaneous increase or decrease in the field-of-view (as represented by X-ray fan area 610), depending on the angle of oscillation $\alpha$, which may be as large as 120°. Oscillating anode 602 is oscillated using any conventional oscillation means, such as an optical gimbal or galvometer provided inside of the X-ray tube.

Figure 7:
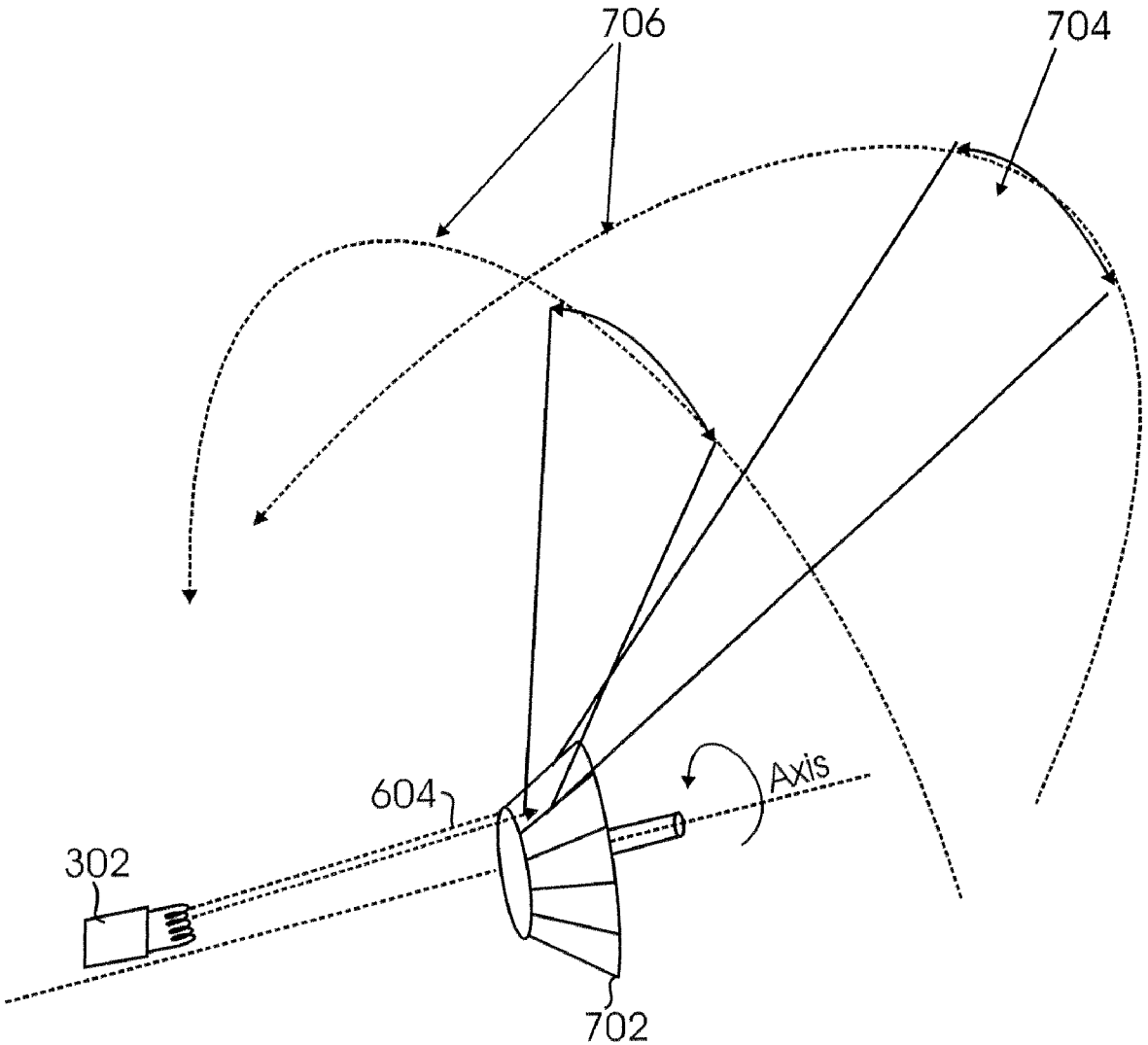
FIG. 7 is a simplified schematic view of the internal structure of an X-ray tube having a rotating anode, according to one embodiment of the disclosure.

FIG. 7 is a simplified schematic view of the internal structure of an X-ray tube having a rotating polygon shaped anode, according to one embodiment of the disclosure. Rotating polygon shaped anode 702 includes faceted sides for changing the angle of incidence of an X-ray beam and the corresponding X-ray beam lobe 704 and curved scanned range 706 that result. By rotating polygon shaped anode 702, the location of electron bombardment and X-ray generation is distributed so that the angle of incidence of the X-ray beam and the corresponding X-ray beam lobe 704 and curved scanned range 706 that result are changed.

Those skilled in the art will recognize that the principles and teachings described herein may be applied to a variety of structures and/or systems, such as aircraft, spacecraft, ground and ocean-going vehicles, complex facilities such as power generation for both commercial and government applications, power plants, processing plants, refineries, military applications, and transportation systems, including, but not limited to, automobiles, ships, helicopters, and trains. Furthermore, the present disclosure may be used for homeland security, as a personnel inspection system (portal) to look for hidden weapons under clothing or in luggage, borescopic applications, such as inspection work where the area to be inspected is inaccessible by other means and in the medical field or where a 360° field of view is required. The X-ray tube can penetrate very large objects, such as vehicles, by going inside the engine compartment or fuel tank which a normal X-ray imaging system cannot access due to size.

Although exemplary embodiments of the disclosure have been described above by way of example only, it will be understood by those skilled in the field that modifications may be made to the disclosed embodiment without departing from the scope of the disclosure, which is defined by the appended claims.

What is claimed is:

1. An X-ray imaging system, comprising:
an X-ray tube including:
a cathode for emitting electrons; and
an anode configured to receive the electrons from the cathode and to generate an X-ray beam;
wherein the anode is rotatable about an axis such that rotation of the anode about the axis induces a sweeping movement of the X-ray beam across an object under examination; and
further wherein the anode is configured to oscillate continuously about the axis between endpoints of oscillation to generate an X-ray fan area.

2. The system of claim 1, wherein the anode rotates about the axis at a rate of between about 5 and 25 revs/sec.

3. The system of claim 1, wherein the anode comprises a single component having a plurality of facets configured to change an angle of incidence of the electrons upon the anode as the anode rotates.

4. The system of claim 3, wherein the anode is further configured to change an X-ray beam lobe and curved scanned range of the system as the anode rotates.

5. The system of claim 1, further comprising a collimator configured to rotate about the axis, wherein rotation of the collimator is linked to rotation of the anode.

6. The system of claim 5, wherein the X-ray beam generated by the rotatable anode is continuously directed toward an aperture defined on the rotating collimator as the rotating collimator moves from a first location to a second location.

7. The system of claim 1, wherein the X-ray tube comprises a continuous circumferential window for allowing the non-stationary X-ray beam to generate a swath that substantially reaches 360°.

8. A method for backscatter X-ray imaging, comprising:
in an X-ray tube, emitting electrons from a cathode;
receiving the electrons from the cathode at an anode and generating an X-ray beam emanating from the anode;

rotating the anode about an axis between a first position where the X-ray beam is directed at a first location on an object under examination and a second position where the X-ray beam is directed at a second location on the object, thereby inducing a sweeping movement of the X-ray beam across the object;

oscillating the anode continuously about the axis between endpoints of oscillation to generate an X-ray fan area;

backscattering X-rays in the X-ray beam from the object;

detecting the backscattered X-rays; and generating an image of the object from the detected backscattered X-rays.

9. The method of claim 8, further comprising rotating a collimator around the axis and around the X-ray tube, the collimator having an aperture for allowing a portion of the X-ray beam to be emitted therethrough.

10. The method of claim 9, further comprising rotating the collimator around the axis and around the X-ray tube, wherein rotation of the collimator is linked to rotation of the rotatable anode.

11. The method of claim 8, wherein the X-ray tube comprises a continuous circumferential window in which the rotatable anode can be rotated substantially 360°.

12. The method of claim 8, wherein the rotatable anode comprises a single component having a plurality of facets configured to change an angle of incidence of the electrons upon the anode as the anode rotates.

13. The method of claim 10, further comprising continuously directing the X-ray beam generated by the anode toward an aperture defined on the rotating collimator as the rotating collimator moves from the first location to the second location.

* * * * *